US007524008B2

(12) United States Patent
Moriya

(10) Patent No.: US 7,524,008 B2
(45) Date of Patent: Apr. 28, 2009

(54) FLUID DISCHARGING DEVICE AND CONTROL METHOD THEREFOR

(75) Inventor: Hidekuni Moriya, Chino-shi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/105,171

(22) Filed: Apr. 17, 2008

(65) Prior Publication Data

US 2009/0009548 A1 Jan. 8, 2009

(30) Foreign Application Priority Data

Jul. 5, 2007 (JP) ..... 2007-177489

(51) Int. Cl.
*B41J 29/38* (2006.01)

(52) U.S. Cl. ..... 347/12; 347/15; 347/41

(58) Field of Classification Search ..... 347/12, 347/15, 40, 41, 43
See application file for complete search history.

(56) References Cited

U.S. PATENT DOCUMENTS 5,692,843 A * 12/1997 Furuya ..... 400/120.02
5,844,585 A * 12/1998 Kurashima et al. ..... 347/43
6,106,100 A * 8/2000 Terasawa et al. ..... 347/40

FOREIGN PATENT DOCUMENTS

JP 2003-118149 4/2003

* cited by examiner

*Primary Examiner*—Lamson D Nguyen
(74) *Attorney, Agent, or Firm*—Hogan & Hartson LLP

(57) ABSTRACT

A fluid discharging device includes: a head having a predetermined number of nozzle arrays in which n (n is an integral number equal to or more than 2) nozzles capable of discharging a predetermined fluid are arranged, the respective nozzle arrays formed to allow the fluid discharged from the kth (k=1, 2, . . . , n) nozzles belonging to the respective nozzle arrays to land on the same position on a target; a supply path that supplies the predetermined fluid to the respective nozzle arrays; a moving unit that relatively moves the head and the target; and a control unit that controls the moving unit to relatively move the head and the target and controls the head in such a manner that, regarding all nozzles belonging to the predetermined number of nozzle arrays, the nozzles are divided into plural groups so that the nozzles belonging to at least two or more nozzle arrays are combined to incorporate first to nth nozzles, the respective groups are as the group for use with predetermined timing, and the nozzles belonging to the set group for use are allowed to discharge the fluid to form dot rows on the target.

7 Claims, 7 Drawing Sheets

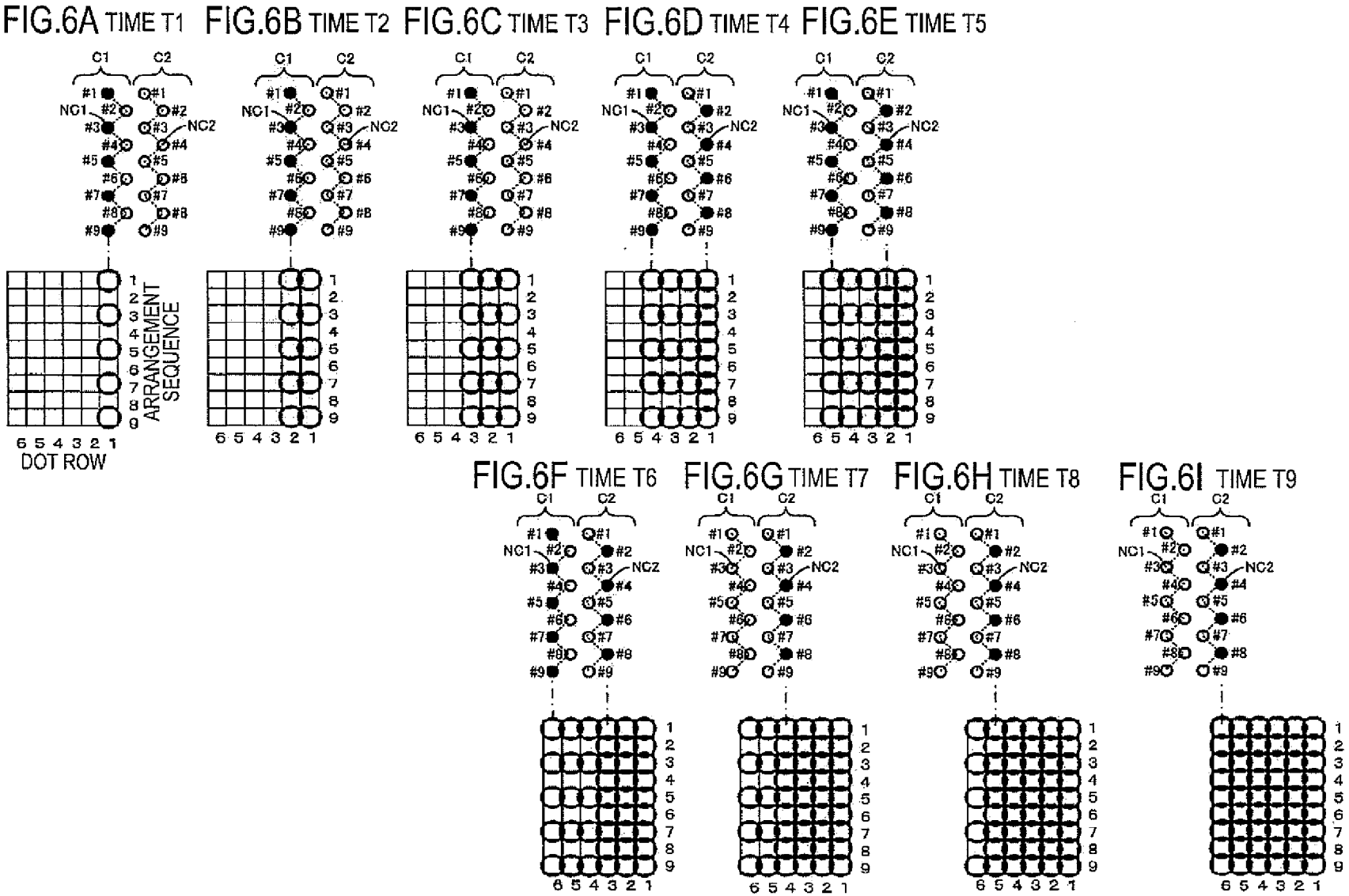
FIG.6A TIME T1
FIG.6B TIME T2
FIG.6C TIME T3
FIG.6D TIME T4
FIG.6E TIME T5
FIG.6F TIME T6
FIG.6G TIME T7
FIG.6H TIME T8
FIG.6I TIME T9
C1
C2
NC1
NC2
DOT ROW
ARRANGEMENT SEQUENCE

TIME T1

TIME T2

TIME T3

TIME T4

TIME T5

TIME T6

TIME T7
C1
C2
NC1
NC2
#1
#2
#3
#4
#5
#6
#7
#8
#9
DOT ROW
ARRANGEMENT SEQUENCE

FLUID DISCHARGING DEVICE AND CONTROL METHOD THEREFOR

BACKGROUND

1. Technical Field

The present invention relates to a fluid discharging device and a control method therefor.

2. Related Art

In the related art, a fluid discharging device for discharging a fluid from a nozzle is known. For example, in a fluid discharging device in JP-A-2003-118149 (paragraphs 0037, 0038), in order to recover a defective nozzle, spare nozzle arrays respectively corresponding to cyan and magenta are formed. In this fluid discharging device, from the standpoint that it is not desirable that the disuse condition of spare nozzle arrays is continued for a long period, main nozzle arrays (not spare nozzle arrays) and the spare nozzle arrays are usually switched for use with respect to each paper of printing or a predetermined number of jobs. As a result, the life of each nozzle becomes longer.

However, in such a fluid discharging device, although the main nozzle arrays and the spare nozzle arrays are switched for use, there are following problems. Since a fluid is typically supplied to the plural nozzles arranged in the main nozzle array in one fluid supply path, when the main nozzle array is used for solid printing, for example, the fluid is discharged from all nozzles arranged in the main nozzle array. Accordingly, crosstalk that the discharging operations of the respective nozzles affect one another via the fluid supply path may occur, the amounts of discharged fluid may change, and landing positions may change. The same occurs with the spare nozzle array.

SUMMARY

An advantage of some aspects of the invention is to extend the life of each nozzle and suppress the crosstalk among nozzles.

A fluid discharging device according to an aspect of the invention includes: a head having a predetermined number of nozzle arrays in which n (n is an integral number equal to or more than 2) nozzles capable of discharging a predetermined fluid are arranged, the respective nozzle arrays formed to allow the fluid discharged from the kth (k=1, 2, . . . , n) nozzles belonging to the respective nozzle arrays to land on the same position on a target; a supply path that supplies the predetermined fluid to the respective nozzle arrays; a moving unit that relatively moves the head and the target; and a control unit that controls the moving unit to relatively move the head and the target and controls the head in such a manner that, regarding all nozzles belonging to the predetermined number of nozzle arrays, the nozzles are divided into plural groups so that the nozzles belonging to at least two or more nozzle arrays are combined to incorporate first to nth nozzles, the respective groups are switched to be set as the group for use with predetermined timing, and the nozzles belonging to the set group for use are allowed to discharge the fluid to form dot rows on the target.

In the fluid discharging device, the moving unit is controlled to relatively move the head and the target and the head is controlled in such a manner that, regarding all nozzles belonging to the predetermined number of nozzle arrays, the nozzles are divided into plural groups so that the nozzles belonging to at least two or more nozzle arrays are combined to incorporate first to nth nozzles, the respective groups are switched to be set as the group for use with predetermined timing, and the nozzles belonging to the set group for use are controlled to discharge the fluid to form dot rows on the target. Thus, the plural nozzles having different fluid supply paths are combined and used for forming one dot row, and the discharge operations of the respective nozzles hardly affect one another via the fluid supply paths. Further, the frequency in use of the respective nozzles becomes lower. Therefore, the life of each nozzle can be extended and the crosstalk among nozzles can be suppressed.

The fluid may be any fluid as long as it can be discharged from a nozzle, for example, an ink used for printing, a liquid agent used for semiconductor manufacturing process, or the like. The target may be any target as long as the fluid can attach to it, for example, paper, fabric, resin plate, metal plate, or the like. The moving unit may be a unit for moving the target relative to the fixed head or moving the head relative to the fixed target, or moving the head in a predetermined direction and moving the target in a direction perpendicular to the predetermined direction. Furthermore, the numeric number n is not specifically limited as long as it is an integral number equal to or more than 2, but determined to be on the order of several tens to several thousands based on the resolution of dots and lengths of nozzle arrays, for example.

In the fluid discharging device according to the aspect of the invention, the head may have two of the nozzle arrays. Three of more nozzle arrays in which nozzles capable of discharging the same fluid are arranged may be formed, but, in this case, the head is likely to be upsized and the cost may be increased. Therefore, it is preferable to provide two, i.e., the minimum number of nozzle arrays for downsizing of the head and cost reduction. In this case, the control unit may make one group of the odd-numbered nozzles belonging to one of the two nozzle arrays and the even-numbered nozzles belonging to the other of the two nozzle arrays, and the other group of the even-numbered nozzles belonging to the one of the two nozzle arrays and the odd-numbered nozzles belonging to the other of the two nozzle arrays. Thus, grouping can be easily performed.

In the fluid discharging device of the aspect of the invention, the nozzles may be arranged in a staggered manner in the respective nozzle arrays. Thus, higher density of nozzles can be realized because the nozzles are arranged in the staggered manner compared to the case where the nozzles are linearly arranged.

In the fluid discharging device of the aspect of the invention, the control unit may switch and set the respective groups as the group for use with respect to each one of the target. The respective groups may be switched with respect to each job, but, in this case, the period for continuously using the same nozzles becomes longer and heat may be stayed around the head. On the other hand, when the groups are switched with respect to each target, the period for continuously using the same nozzles becomes shorter and heat hardly stays around the head.

In the fluid discharging device of the aspect of the invention, the head may be a line head formed to have the nozzle arrays in length equal to or more than a width of the target. When such a line head is adopted, the head is upsized and the discharge operations of the respective nozzles are more likely to affect one another via the fluid supply paths. Therefore, it is of great significance to apply the aspect of the invention.

A control method for a fluid discharging device according to another aspect of the invention is a control method for a fluid discharging device including a head having a predetermined number of nozzle arrays in which n (n is an integral number equal to or more than 2) nozzles capable of discharging a predetermined fluid are arranged, the respective nozzle arrays formed to allow the fluid discharged from the kth (k=1, 2, . . . , n) nozzles belonging to the respective nozzle arrays to land on the same position on a target, a supply path that supplies the predetermined fluid to the respective nozzle arrays, a moving unit that relatively moves the head and the target, and the method includes controlling the moving unit to relatively move the head and the target and controlling the head in such a manner that, regarding all nozzles belonging to the predetermined number of nozzle arrays, the nozzles are divided into plural groups so that the nozzles belonging to at least two or more nozzle arrays are combined to incorporate first to nth nozzles, the respective groups are switched to be set as the group for use with predetermined timing, and the nozzles belonging to the set group for use are allowed to discharge the fluid to form dot rows on the target.

In the control method for a fluid discharging device, the moving unit is controlled to relatively move the head and the target and the head is controlled in such a manner that, regarding all nozzles belonging to the predetermined number of nozzle arrays, the nozzles are divided into plural groups so that the nozzles belonging to at least two or more nozzle arrays are combined to incorporate first to nth nozzles, the respective groups are switched to be set as the group for use with predetermined timing, and the nozzles belonging to the set group for use are controlled to discharge the fluid to form dot rows on the target. Thus, the plural nozzles having different fluid supply paths are combined and used for forming one dot row, and the discharge operations of the respective nozzles hardly affect one another via the fluid supply paths. Further, the frequency in use of the respective nozzles becomes lower. Therefore, the life of each nozzle can be extended and the crosstalk among nozzles can be suppressed. Note that, in the control method, some steps may be added for realizing actions and functions exerted by the various configurations of the above described fluid discharging device of the embodiment.

BRIEF DESCRIPTION OF THE DRAWINGS

The invention will be described with reference to the accompanying drawings, wherein like numbers reference like elements.

FIGS. 6A to 6I are explanatory diagrams showing relationships between elapsed time and dots formed on recording paper S.

DESCRIPTION OF EXEMPLARY EMBODIMENTS

Figure 1:
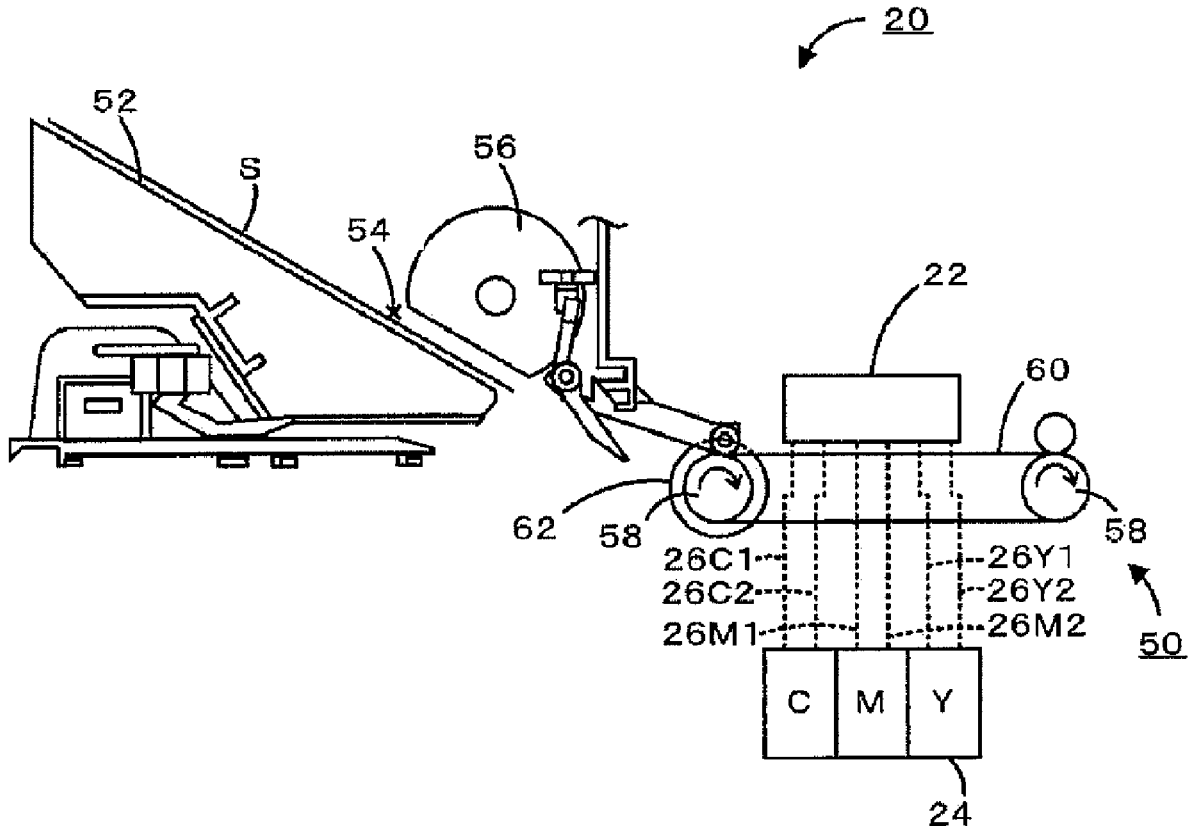
FIG. 1 is a sectional view showing a schematic configuration of an inkjet printer 20.
Figure 2:
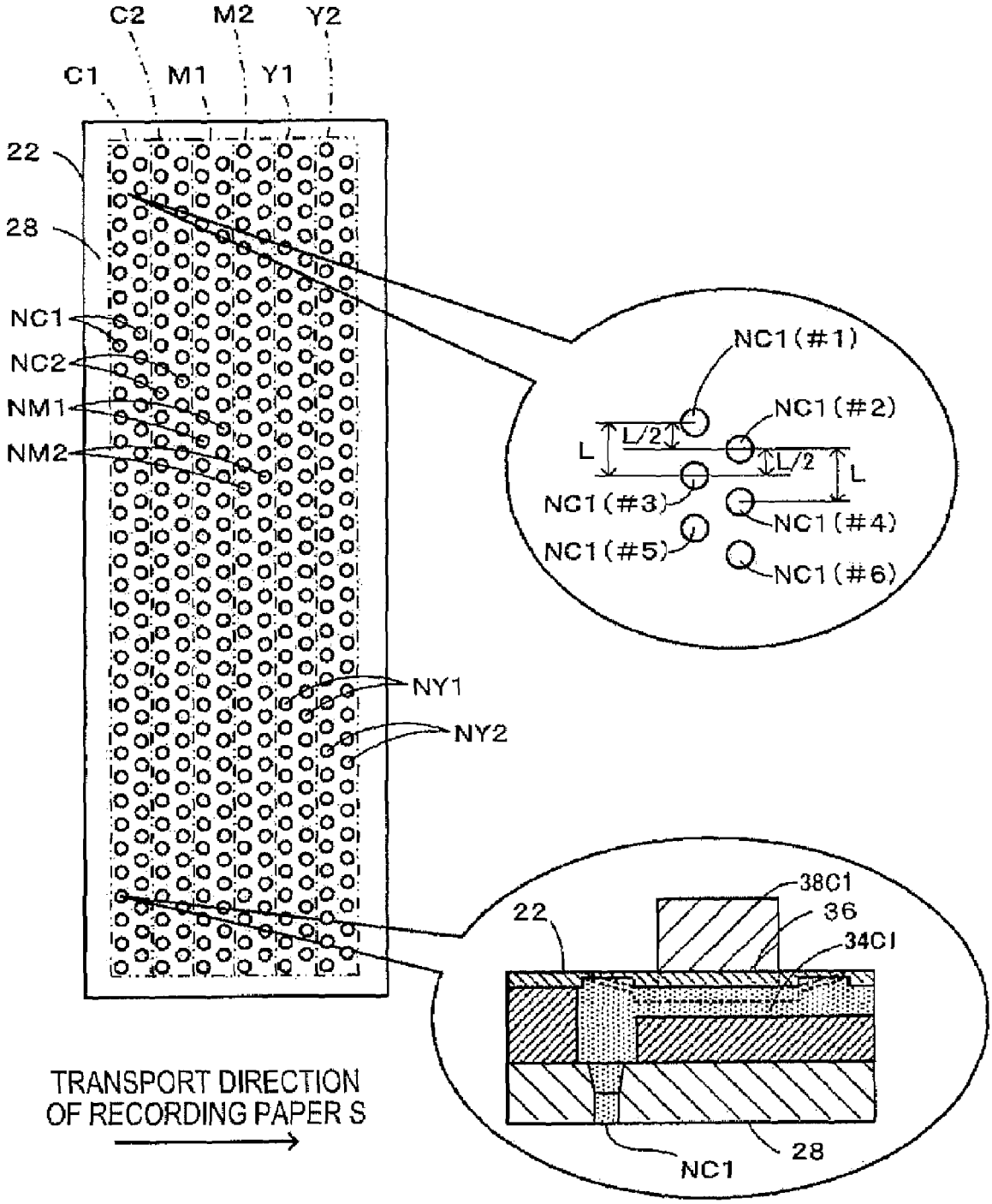
FIG. 2 is an explanatory diagram showing a schematic configuration of a line head 22.
Figure 3:
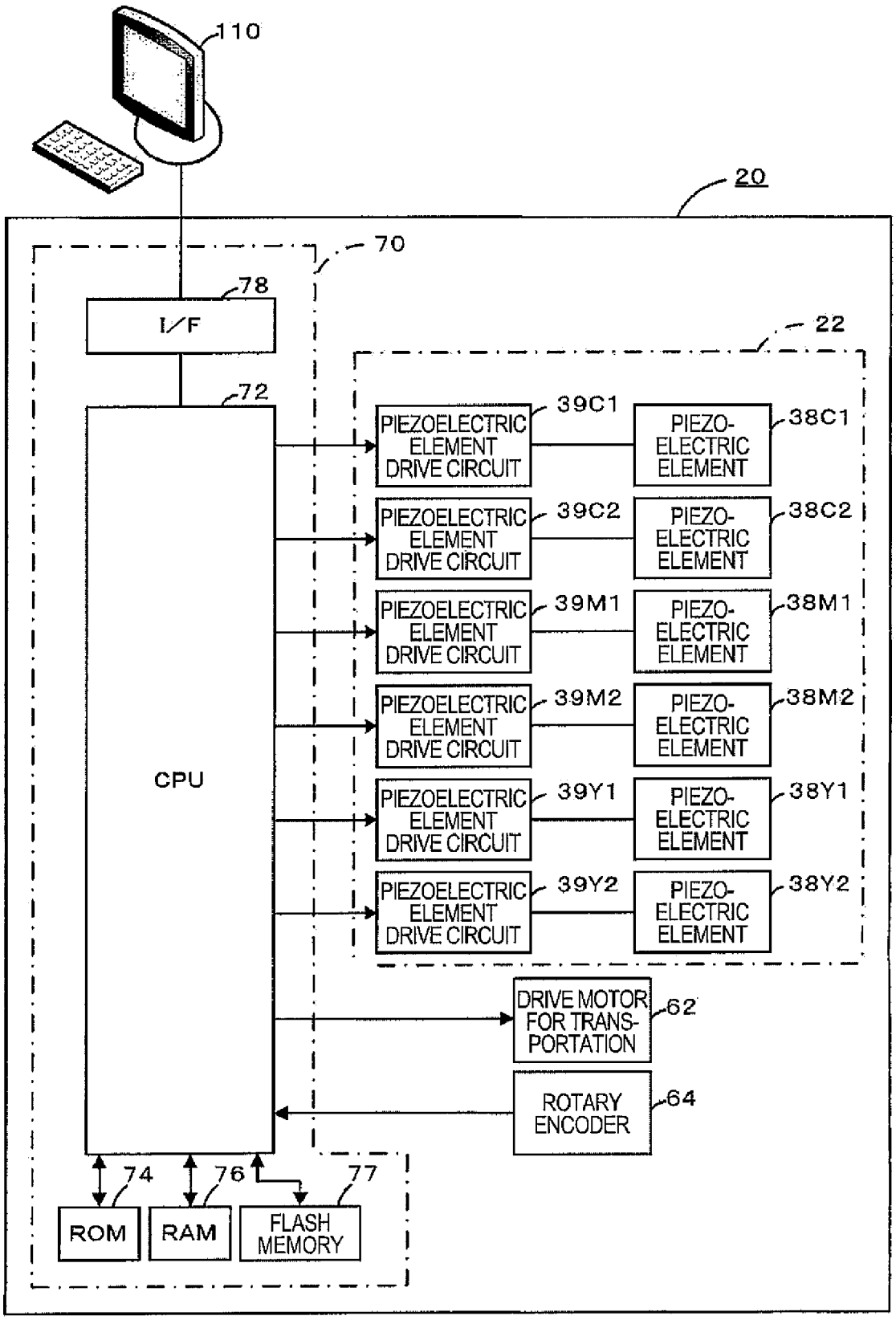
FIG. 3 is an explanatory diagram showing electric connection of the inkjet printer 20.

Now, one embodiment embodying the invention will be described. FIG. 1 is a sectional view showing a schematic configuration of an inkjet printer 20 as the embodiment, FIG. 2 is an explanatory diagram showing a schematic configuration of a line head 22, and FIG. 3 is an explanatory diagram showing electric connection of the inkjet printer 20.

As shown in FIG. 1, the inkjet printer 20 of the embodiment has the line head 22 that performs printing by discharging ink droplets onto recording paper S to be transported from a paper feed tray 52, a paper feed mechanism 50 including a belt 60 hung around a pair of transport rollers 58, 58 driven by a drive motor 62 for transportation, and a controller 70 (see FIG. 3) that controls the entire of the inkjet printer 20.

The line head 22 is formed in a nearly rectangle parallelepiped shape and fixed to the printer main body with the longitudinal direction perpendicular to the transport direction. The line head 22 is connected via an ink cartridge 24 separately containing inks of the respective colors of cyan (C), magenta (M), and yellow (Y). The line head 22 has a nozzle plate 28 at the bottom as shown in FIG. 2. On the nozzle plate 28, a first cyan nozzle array C1 in which n first cyan nozzles NC1 capable of discharging a cyan (C) ink are arranged, a second cyan nozzle array C2 in which n second cyan nozzles NC2 also capable of discharging a cyan (C) ink are arranged, a first magenta nozzle array M1 in which n first magenta nozzles NM1 capable of discharging a magenta (M) ink are arranged, a second magenta nozzle array M2 in which n second magenta nozzles NM2 also capable of discharging a magenta (M) ink are arranged, a first yellow nozzle array Y1 in which n first yellow nozzles NY1 capable of discharging a yellow (Y) ink are arranged, a second yellow nozzle array Y2 in which n second yellow nozzles NY2 also capable of discharging a yellow (Y) ink are arranged are respectively formed. The lengths of the respective nozzle arrays C1, C2, M1, M2, Y1, and Y2 are equal to or more than paper width of recording paper in the maximum size of printable paper. Further, the numeric value n is a value determined based on the resolution of dots and the lengths of the nozzle arrays, about several tens to several thousands (here, several hundreds). The line head 22 and the ink cartridge 24 are connected by six tubes 26C1, 26C2, 26M1, 26M2, 26Y1, and 26Y2 as shown in FIG. 1. In the line head 22, the ink is supplied to the first cyan nozzle array C1 via the first cyan tube 26C1, and the ink is supplied to the second cyan nozzle array C2 via the second cyan tube 26C2. Further, the ink is supplied to the first magenta nozzle array M1 via the first magenta tube 26M1, the ink is supplied to the second magenta nozzle array M2 via the second magenta tube 26M2, the ink is supplied to the first yellow nozzle array Y1 via the first yellow tube 26Y1, and the ink is supplied to the second yellow nozzle array Y2 via the second yellow tube 26Y2. In the embodiment, black (K) is formed by mixing cyan (C), magenta (M), and yellow (Y), however, a black (K) ink array may be separately provided.

Here, the first cyan nozzle array C1 will be described as an example. When the first cyan nozzle array C1 is seen along the longitudinal direction, plural first cyan nozzles NC1 forming the first cyan nozzle array C1 are arranged in a staggered manner. Specifically, the odd-numbered (#1, 3, 5, . . . ) first cyan nozzles NC1 are linearly arranged at a pitch of a predetermined length L along the longitudinal direction, and the even-numbered (#2, 4, 6, . . . ) first cyan nozzles NC1 are linearly arranged in parallel with the arrangement direction of the odd-numbered first cyan nozzles NC1 at a pitch of the predetermined length L. The adjacent odd-numbered first cyan nozzle NC1 and even-numbered first cyan nozzle NC1 are arranged at a pitch of a half of the predetermined length L (L/2) In the embodiment, the predetermined length L is determined so that dots may provide resolution of 180 dpi, the resolution of printed matter to be obtained is 360 dpi because printing is performed with the recording paper S transported so that the dots formed by the ink discharged from the odd-numbered first cyan nozzles NC1 and the dots formed by the ink discharged from the even-numbered first cyan nozzle NC1 may be arranged in a line. The resolution can be made higher by appropriately shortening the predetermined length L. The first cyan nozzles NC1 are communicated with an ink chamber 34C1 provided inside the line head 22. In the ink chamber 34C1, when a voltage is applied to a piezoelectric element 38C1 attached to a vibrating plate 36 forming an upper wall of the ink chamber 34C1, the piezoelectric element 38C1 deforms and compresses the volume inside the chamber (see the dotted line within the lower circle in FIG. 2), and, when the application of the voltage is canceled, the piezoelectric element 38C1 is restored and the volume inside the chamber returns. Thereby, the ink is discharged from the first cyan nozzles NC1. The second cyan nozzle array C2 is formed adjacently to the first cyan nozzle array C1 completely in the same fashion as that of the first cyan nozzle array C1. That is, the first and second cyan nozzle arrays C1 and C2 are formed so that the position on the recording paper S where the ink discharged from the kth (k=1, 2, . . . , n) first cyan nozzle NC1 of the first cyan nozzle array C1 lands and the position on the recording paper S where the ink discharged from the kth second cyan nozzle NC2 of the second cyan nozzle array C2 lands may be the same.

Figure 4:
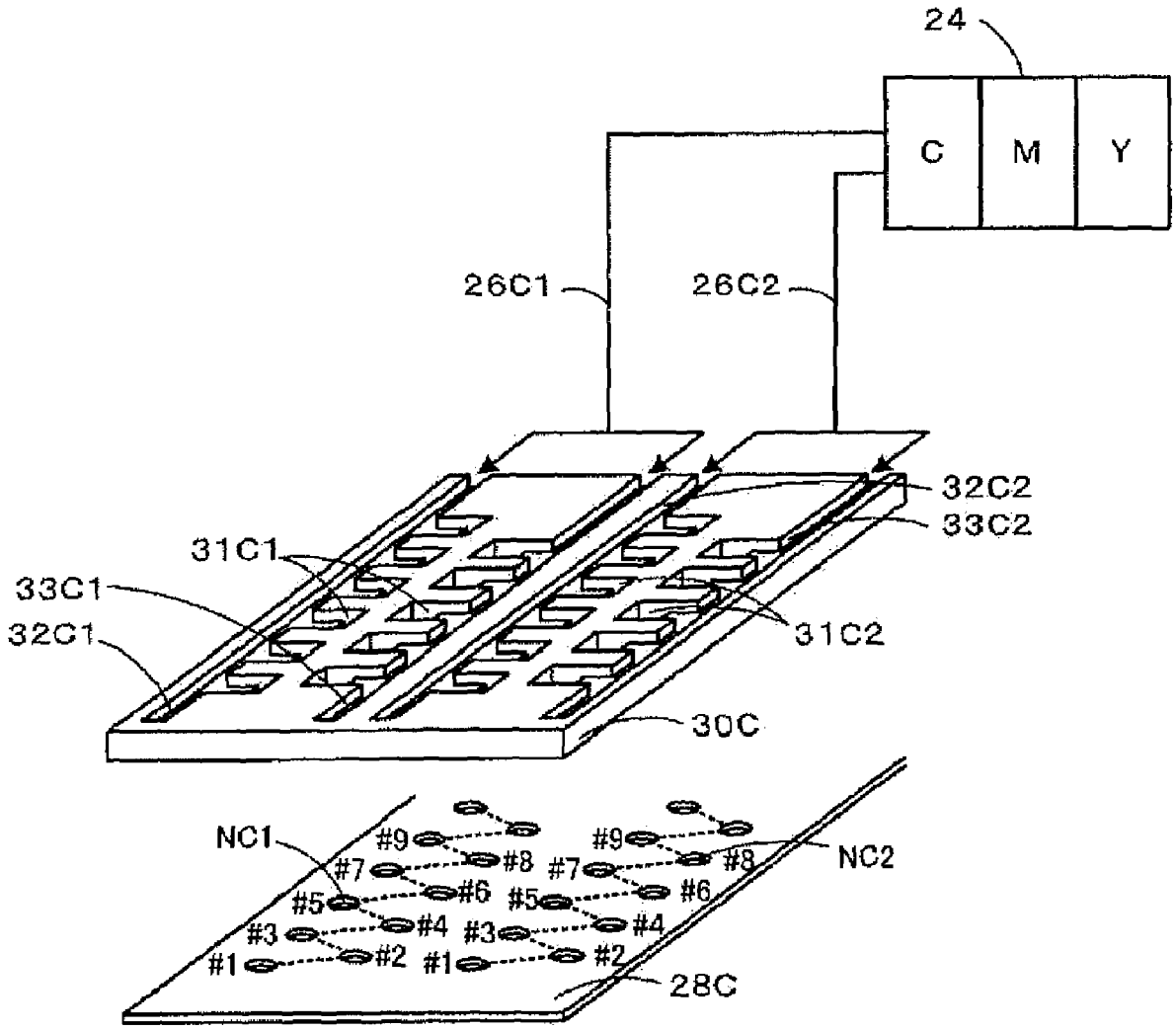
FIG. 4 is a partially exploded perspective view of a cyan nozzle plate 28C and surrounding members.

FIG. 4 is a partially exploded perspective view showing internal structures of the first and second cyan nozzles NC1, NC2. As shown in FIG. 4, the line head 22 includes a cyan nozzle plate 28C as a part of the nozzle plate 28, and a cyan cavity plate 30C stacked on the cyan nozzle plate 28C. On the cyan nozzle plate 28C, the first cyan nozzles NC1 are sequentially formed from the #1 nozzle in the staggered manner, and the second cyan nozzles NC2 are sequentially formed from the #1 nozzle in the staggered manner. On the cyan cavity plate 30C, cavities 31C1 as the ink chambers 34C1 (see FIG. 2) are formed correspondingly to the respective first cyan nozzles NC1, and the similar cavities 31C2 are formed correspondingly to the respective second cyan nozzles NC2. Of the cavities 31C1 formed on the cyan cavity plate 30C, the cavities 31C1 corresponding to the odd-numbered first cyan nozzles NC1 are communicated by a longitudinal groove 32C1, and the cavities 31C1 corresponding to the even-numbered first cyan nozzles NC1 are communicated by a longitudinal groove 33C1. Further, of the cavities 31C2, the cavities 31C2 corresponding to the odd-numbered second cyan nozzles NC2 are communicated by a longitudinal groove 32C2, and the cavities 31C2 corresponding to the even-numbered second cyan nozzles NC2 are communicated by a longitudinal groove 33C2. A cyan tank containing the cyan ink of the ink cartridge 24 and the line head 22 are connected by the first and second cyan tubes 26C1, 26C2, the first cyan tube 26C1 can supply the cyan ink to the respective longitudinal grooves 32C1, 33C1 via a pump (not shown), and the second cyan tube 26C2 can supply the cyan ink to the respective longitudinal grooves 32C2, 33C2 via a pump (not shown). On the cyan cavity plate 30C, the vibrating plate 36 (see FIG. 2) is further stacked and the piezoelectric elements 38C1 (see FIGS. 1 and 2) corresponding to the respective first cyan nozzles NC1 and the piezoelectric elements 38C2 (see FIG. 2) corresponding to the respective second cyan nozzles NC2 are stacked on the vibrating plate 36, however, they are omitted in FIG. 4. The first and second magenta nozzle arrays M1, M2, and the first and second yellow nozzle arrays Y1, Y2 are formed in the same manner as the first and second cyan arrays C1, C2, and their detailed description is omitted here.

As shown in FIG. 1, the paper feed mechanism 50 includes a recording paper insertion opening 54 into which recording paper S mounted on the paper feed tray 52 is inserted, a paper feed roller 56 that feeds the recording paper S mounted on the paper feed tray 52 to the line head 22, the endless belt 60 hung around the pair of transport rollers 58, 58 for electrostatistically attracting or vacuum-attracting and transporting the recording paper S. The paper feed mechanism 50 transports the recording paper S in a direction perpendicular to the arrangement direction of the ink nozzle arrays formed on the line head 22. One of the pair of transport rollers 58, 58 is a driving roller driven by the drive motor 62 and the other is a driven roller that rotates according to the rotation of the driving roller. The paper feed roller 56 and the driving roller of the pair of transport rollers 58, 58 are driven by the drive motor 62 for transportation via a gear mechanism (not shown).

As shown in FIG. 3, the controller 70 is configured as a microprocessor centering on a CPU 72, and includes a ROM 74 that stores various kinds of processing programs, a RAM 76 that temporarily stores or saves data, a flash memory 77 that can freely delete and write data and hold contents after the power is turned off, an interface (I/F) 78 that exchanges information between an external device and itself, and an input/output port (not shown). To the controller 70, signals on the position of the recording paper S from a rotary encoder 64 attached to the drive motor 62 for transportation are input via an input port (not shown), and further, print jobs output from a user PC 110 or the like are input via the I/F 78. From the controller 70, drive signals to piezoelectric element drive circuits 39C1, 39C2, 39M1, 39M2, 39Y1, and 39Y2 for driving the piezoelectric elements 38C1, 38C2, 38M1, 38M2, 38Y1, and 38Y2 of the line head 22 and control signals to the drive motor 62 for transportation are output via an output port (not shown), and further, print status information to the user PC 110 and the like are output via the I/F 78. In the ROM 74, the respective processing programs such as a print control routine, which will be described later, are stored. Further, a buffer space for printing is provided in the RAM 76. In the buffer space for printing, print data sent from the user PC 110 via the I/F 78 is temporarily stored.

In the embodiment, ink nozzles are divided into two groups A, B. The group A includes the odd-numbered first cyan nozzles NC1 connected to the first cyan tube 26C1 and the even-numbered second cyan nozzles NC2 connected to the second cyan tube 26C2, the odd-numbered first magenta nozzles NM1 connected to the first magenta tube 26M1 and the even-numbered second magenta nozzles NM2 connected to the second magenta tube 26M2, and the odd-numbered first yellow nozzles NY1 connected to the first yellow tube 26Y1 and the even-numbered second yellow nozzles NY2 connected to the second yellow tube 26Y2. Further, the group B includes the even-numbered first cyan nozzles NC1 connected to the first cyan tube 26C1 and the odd-numbered second cyan nozzles NC2 connected to the second cyan tube 26C2, the even-numbered first magenta nozzles NM1 connected to the first magenta tube 26M1 and the odd-numbered second magenta nozzles NM2 connected to the second magenta tube 26M2, and the even-numbered first yellow nozzles NY1 connected to the first yellow tube 26Y1 and the odd-numbered second yellow nozzles NY2 connected to the second yellow tube 26Y2. The ink nozzles are divided into the two groups A, B in this manner, and thereby, there are sequentially from first to nth ink nozzles of the same color belonging to the same group. Further, the half of the ink nozzles of the same color belonging to the same group are supplied with ink from the same ink tube, while the rest of the ink nozzles are supplied with ink from another tube. The information on which of the groups A, B includes which ink nozzle is stored in the ROM 74 in advance.

Figure 5:
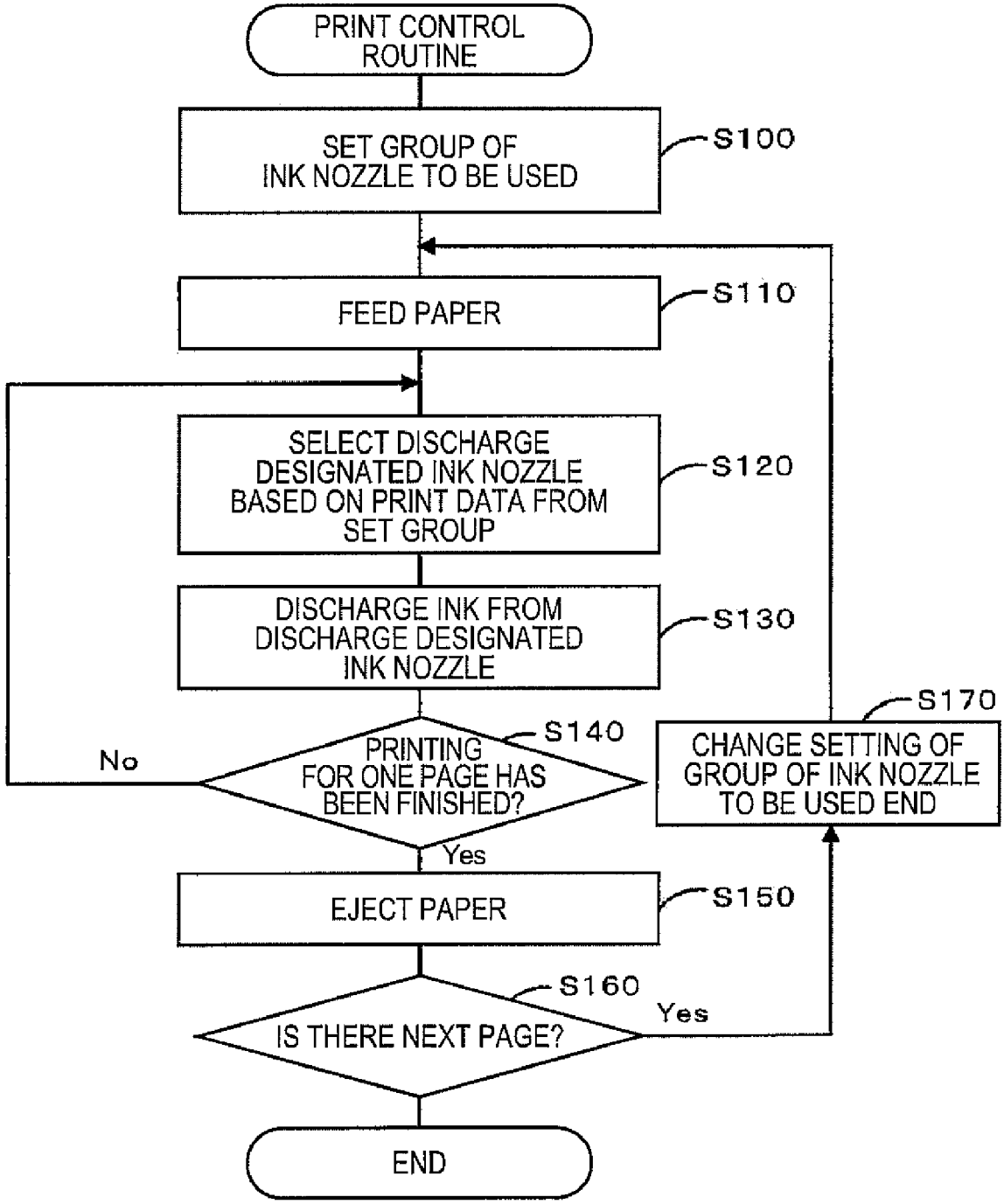
FIG. 5 is a flowchart of a print control routine.

Next, an operation of the inkjet printer 20 of the embodiment having the above described configuration will be explained. FIG. 5 is a flowchart of the print control routine. When a print job is input from the user PC 110, the CPU 72 of the controller 70 loads the print control routine program from the ROM 74 and executes the program. When the print control routine is started, the CPU 72 first sets a group of ink nozzles to be used (step S100) If the print control routine is first executed after factory shipment, the group A is set. If the print control routine has been executed in the past, the group different from the last group set in the previous printing is set. Subsequently, paper feed processing is executed (step S110). The paper feed processing is processing of rotationally driving the paper feed roller 56 and the pair of transport rollers 58, 58 by driving the drive motor 62, and transporting the recording paper S until the print starting point of the recording paper S mounted on the paper feed tray 52 comes to a predetermined position facing to the line head 22. Then, the CPU 72 selects nozzles to discharge ink (discharge-designated nozzles) based on the print data contained in the print job from the nozzles included in the set group (step S120). For example, if the set group is the group A, the discharge-designated nozzles are selected from the odd-numbered first cyan nozzles NC1 and the even-numbered second cyan nozzles NC2, the odd-numbered first magenta nozzles NM1 and the even-numbered second magenta nozzles NM2, and the odd-numbered first yellow nozzles NY1 and the even-numbered second yellow nozzles NY2. Further, if the set group is the group B, the discharge-designated nozzles are selected from the even-numbered first cyan nozzles NC1 and the odd-numbered second cyan nozzles NC2, the even-numbered first magenta nozzles NM1 and the odd-numbered second magenta nozzles NM2, and the even-numbered first yellow nozzles NY1 and the odd-numbered second yellow nozzles NY2.

Subsequently, in order that the inks are discharged from the selected discharge-designated nozzles, the control signals are sent to the piezoelectric element drive circuits 39C1, 39C2, 39M1, 39M2, 39Y1, and 39Y2 (step S130). Then, whether printing for one page has been finished or not is determined (step S140), and if the printing for one page has been not finished, the processing at steps S120 to S140 is executed again. While the processing at steps S120 to S140 is repeated, the pair of transport rollers 58, 58 are rotated by driving the drive motor 62 to transport the recording paper S at a predetermined speed. The predetermined speed for transportation of the recording paper S is determined so that dots formed on the recording paper S provide resolution of 360 dpi. Such processing is repeatedly executed, and if determined that the printing for one page has been finished at step S140, paper eject processing is executed (step S150). The paper eject processing is processing of rotationally driving the pair of transport rollers 58, 58 by driving the drive motor 62 to eject the printed recording paper S onto a receiving tray (not shown). Subsequently, whether there is the next page to be printed or not is determined (step S160), and, if there is the next page, the group of the ink nozzles for use is changed to the group different from the currently set group (step S170). Then, the process returns to step S110 again, and, if there is no next page, this routine is ended.

Next, the dots formed in the print control routine will be described. FIGS. 6A to 6I are explanatory diagrams showing relationships between elapsed time and dots formed on the recording paper S when dots of cyan ink are solidly formed on the entire surface of the recording paper S in the case where the group of ink nozzles for use is set to the group A. Here, the dot rows to be formed on the recording paper S are dot rows of total six rows from the first row to the sixth row, and total nine dots from first dot to the ninth dot are arranged in each dot row. Further, the piezoelectric elements 38C1 of the first cyan nozzles NC1 of the first cyan nozzle array C1 are driven when the odd-numbered dot arrays are formed, and the piezoelectric elements 38C2 of the second cyan nozzles NC2 of the second cyan nozzle array C2 are driven when the odd-numbered dot rows are formed. The times T1 to T9 represent times at which the recording paper S is transported by one dot.

At time T1, as shown in FIG. 6A, the first dot row on the recording paper S faces the odd-numbered first cyan nozzles NC1 of the first cyan nozzle array C1. Then, ink is discharged from the odd-numbered first cyan nozzles NC1, and dots are formed in the first dot row of the recording paper S at double intervals. At times T2, T3, the ink is discharged in the same manner. That is, in FIG. 6B at time T2, dots are formed in the second dot row of the recording paper S at double intervals, and, in FIG. 6C at time T3, dots are formed in the third dot row of the recording paper S at double intervals. At time T4, as shown in FIG. 6D, the fourth dot row on the recording paper S faces the odd-numbered first cyan nozzles NC1 of the first cyan nozzle array C1, and the first dot row on the recording paper S faces the even-numbered second cyan nozzles NC2 of the second cyan nozzle array C2. Then, the ink is discharged from the odd-numbered first cyan nozzles NC1 of the first cyan nozzle array C1, and dots are formed in the fourth dot row of the recording paper S at double intervals. Simultaneously, the ink is discharged from the even-numbered second cyan nozzles NC2 of the second cyan nozzle array C2, and dots are formed to fill the gaps between dots formed at double intervals in the first dot row of the recording paper S. Thereby, the first dot row is entirely filled with the dots. At times T5, T6, the ink is discharged in the same manner. That is, in FIG. 6E at time T5, the second dot row of the recording paper S is filled with dots and dots are formed in the fifth dot row at double intervals, and, in FIG. 6F at time T6, the third dot row of the recording paper S is filled with dots and dots are formed in the sixth dot row at double intervals. At time T7, as shown in FIG. 6G, the fourth dot row of the recording paper S faces the even-numbered second cyan nozzles NC2 of the second cyan nozzle array C2. Then, the ink is discharged from the even-numbered second cyan nozzles NC2, and dots are formed to fill the fourth dot row of the recording paper S. At times T8, T9, the ink is discharged in the same manner. That is, in FIG. 6H at time T8, the fifth dot row of the recording paper S is filled with dots, and, in FIG. 6I at time T9, the sixth dot row of the recording paper S is filled with dots. Thus, the first to sixth dot rows of the recording paper S are completely filled with the dots formed by the cyan ink.

FIGS. 7A to 7G are explanatory diagrams showing relationships between elapsed time and dots formed on the recording paper S when dots of cyan ink are solidly formed on the entire surface of the recording paper S in the case where the group of ink nozzles for use is set to the group B.

Figures 7A, 7B, 7C, 7D, 7E, 7F, 7G:
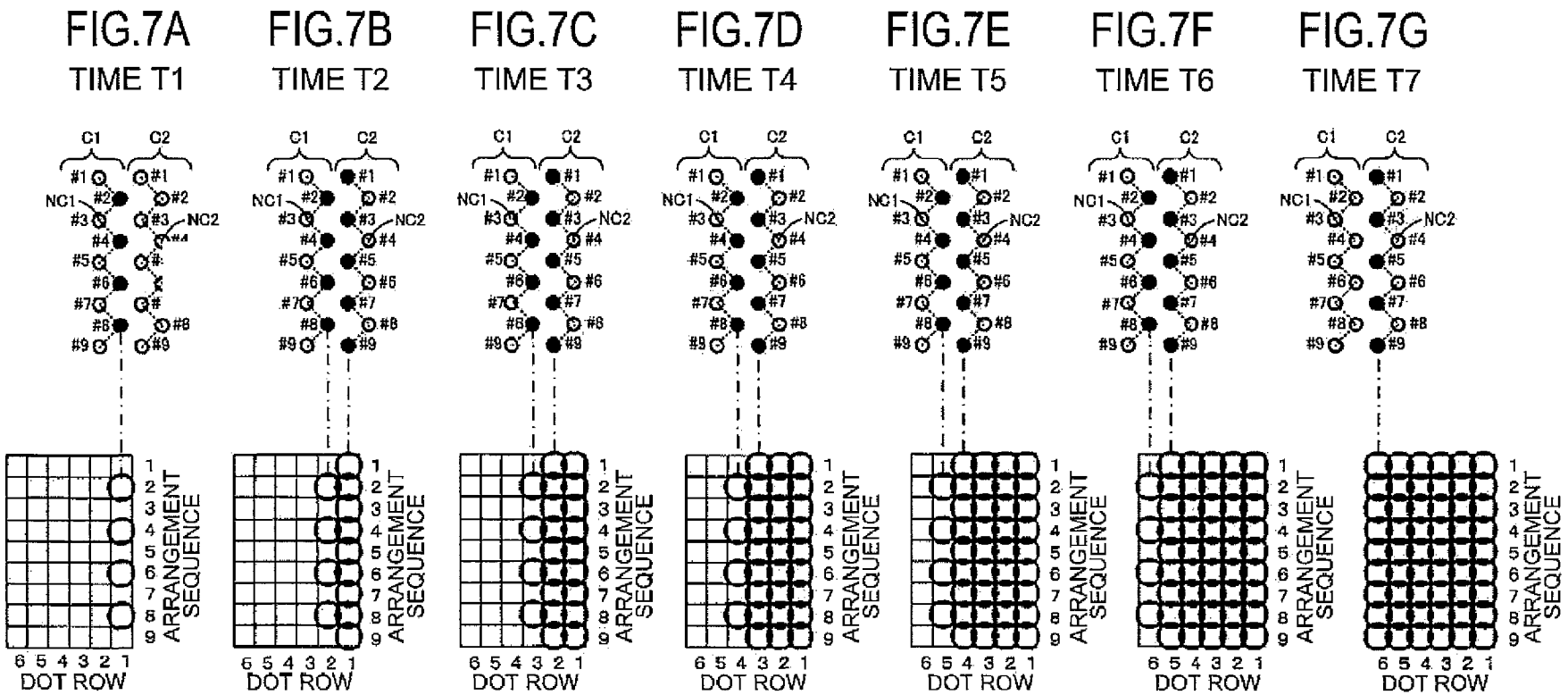
FIGS. 7A to 7G are explanatory diagrams showing relationships between elapsed time and dots formed on recording paper S.

At time T1, as shown in FIG. 7A, the first dot row on the recording paper S faces the even-numbered first cyan nozzles NC1 of the first cyan nozzle array C1. Then, the ink is discharged from the even-numbered first cyan nozzles NC1, and dots are formed in the first dot row of the recording paper S at double intervals. At time T2, as shown in FIG. 7B, the second dot row on the recording paper S faces the even-numbered first cyan nozzles NC1 of the first cyan nozzle array C1, and the first dot row faces the odd-numbered second cyan nozzles NC2 of the second cyan nozzle array C2. Then, the ink is discharged from the even-numbered first cyan nozzles NC1 of the first cyan nozzle array C1, and dots are formed in the second dot row of the recording paper S at double intervals. Simultaneously, the ink is discharged from the odd-numbered second cyan nozzles NC2 of the second cyan nozzle array C2, and dots are formed to fill the gaps between dots formed at double intervals in the first dot row of the recording paper S. Thereby, the first dot row is entirely filled with the dots. At times T3 to T6, the ink is discharged in the same manner. That is, in FIG. 7C at time T3, the second dot row of the recording paper S is filled with dots and dots are formed in the third dot row at double intervals, in FIG. 7D at time T4, the third dot row of the recording paper S is filled with dots and dots are formed in the fourth dot row at double intervals, in FIG. 7E at time T5, the fourth dot row of the recording paper S is filled with dots and dots are formed in the fifth dot row at double intervals, and, in FIG. 7F at time T6, the fifth dot row of the recording paper S is filled with dots and dots are formed in the sixth dot row at double intervals. At time T7, as shown in FIG. 7G, the sixth dot row on the recording paper S faces the odd-numbered second cyan nozzles NC2 of the second cyan nozzle array C2. Then, the ink is discharged from the odd-numbered second cyan nozzles NC2, and the sixth dot row of the recording paper S is filled with dots. Thus, the first to sixth dot rows on the recording paper S are completely filled with the dots formed by the cyan ink.

The correspondences between the component elements of the embodiment and the component elements of the invention are as follows. The inkjet printer 20 of the embodiment corresponds to a fluid discharging device of the invention, the line head 2 corresponds to a head, the first and second cyan tubes 26C1, 26C2, the first and second magenta tubes 26M1, 26M2, and the first and second yellow tubes 26Y1, 26Y2 correspond to a supply path, the paper feed mechanism 50 corresponds to a moving unit, and the controller 70 corresponds to a control unit. Further, when a predetermined fluid is a cyan ink, the first and second cyan nozzle arrays C1, C2 correspond to a nozzle array in which n nozzles capable of discharging the predetermined fluid are arranged, when predetermined fluid is a magenta ink, the first and second magenta nozzle arrays M1, M2 correspond to a nozzle array in which n nozzles capable of discharging the predetermined fluid are arranged, and, when the first and second yellow nozzle arrays Y1, Y2 correspond to a nozzle array in which n nozzles capable of discharging the predetermined fluid are arranged. The embodiment makes an example of the control method for the fluid discharging device of the invention clear by describing the operation of the inkjet printer 20.

According to the above specifically described inkjet printer 20 of the embodiment, taking cyan as an example, for forming the first dot row, the combination of the odd-numbered first cyan nozzles NC1 supplied with ink by the first cyan tube 26C1 and the even-numbered second cyan nozzles NC2 supplied with ink by the second cyan tube 26C2 or the combination of the even-numbered first cyan nozzles NC1 supplied with ink by the first cyan tube 26C1 and the odd-numbered second cyan nozzles NC2 supplied with ink by the second cyan tube 26C2 is used. Accordingly, the chances that the discharging operations of the respective first cyan nozzles NCI affect one another via the first cyan tube 26C1 and the discharging operations of the respective second cyan nozzles NC2 affect one another via the second cyan tube 26C2 are reduced. The same is true for the other colors. Therefore, crosstalk among nozzles can be suppressed. Further, the respective nozzles repeat ink discharge and discharge pause with respect to each page, and the drive frequency becomes ½ compared to the case where ink discharge is performed at every time. Therefore, the life of each nozzle is extended and heat hardly stay around the line head 22.

The invention is not limited to the above described embodiment and can be put into practice in various embodiments within the technical scope of the invention.

For example, in the above described embodiment, the line head 22 for color printing has been illustrated, however, the invention may be applied to a line head for monochrome printing including the respective ink nozzle arrays of only black nozzles that discharge a black (K) ink.

In the above described embodiment, the nozzles contained in the respective nozzle arrays are arranged in the staggered manner, however, they may be linearly arranged. Also, in this case, ink discharge and discharge pause are repeated after each sheet of recording paper S is printed, and the durability of nozzles is improved.

In the above described embodiment, the system of discharging ink by deforming the piezoelectric element to press the ink in the ink chamber has been adopted, however, a system of discharging ink by heating the ink in the ink chamber with a heating resistor (e.g., a heater) to produce air bubbles for pressing the ink may be adopted.

In the above described embodiment, two nozzle arrays are formed for the respective color inks, however, three or more arrays may be formed. For example, when three nozzle arrays are formed for the respective color inks, regarding all nozzles belonging to the three nozzle arrays, the nozzles may be divided into plural groups so that the nozzles belonging to at least two or more nozzle arrays may be combined to provide sequentially from first to nth nozzles, the respective groups may be switched and set as the group for use at each time when one page is printed, and the fluid may be discharged from the nozzles belonging to the set group for use to form dot rows on the recording paper S.

In the above described embodiment, the line head 22 fixed to the printer main body is used, however, the respective ink nozzle arrays may be formed on a head mounted on a carriage movable in a direction perpendicular to the transport direction of the recording paper S may be adopted.

In the above described embodiment, the inkjet printer 20 has been illustrated, however, the invention may be applied to a multifunction printer having both a scanner and a printer, or a facsimile machine.

The entire disclosure of Japanese Patent Application No. 2007-177489, filed Jul. 5, 2007 is expressly incorporated by reference herein.

What is claimed is:

1. A fluid discharging device, comprising:

a head having a predetermined number of nozzle arrays in which n (n is an integral number equal to, or more than 2) nozzles capable of discharging a predetermined fluid are arranged, the respective nozzle arrays formed to allow the fluid discharged from the kth (k=1, 2, . . . , n) nozzles belonging to the respective nozzle arrays to land on the same position on a target;

a supply path that supplies the predetermined fluid to the respective nozzle arrays;

a moving unit that relatively moves the head and the target; and a control unit that controls the moving unit to relatively move the head and the target and controls the head in such a manner that, regarding all nozzles belonging to the predetermined number of nozzle arrays, the nozzles are divided into plural groups so that the nozzles belonging to at least two or more nozzle arrays are combined to incorporate the first to nth nozzles, the respective groups are switched to be set as a group for use with predetermined timing, and the nozzles belonging to the group for use are allowed to discharge the fluid to form dot rows on the target.

2. The fluid discharging device according to claim 1, wherein the head has two of the nozzle arrays.

3. The fluid discharging device according to claim 2, wherein the control unit makes one group of the odd-numbered nozzles belonging to one of the two nozzle arrays and the even-numbered nozzles belonging to the other of the two nozzle arrays, and the other group of the even-numbered nozzles belonging to the one of the two nozzle arrays and the odd-numbered nozzles belonging to the other of the two nozzle arrays.

4. The fluid discharging device according to claim 1, wherein the nozzles are arranged in a staggered manner in the respective nozzle arrays.

5. The fluid discharging device according to claim 1, wherein the control unit switches and sets the respective groups as the group for use with respect to each one of the target.

6. The fluid discharging device according to claim 1, wherein the head is a line head formed to have the nozzle arrays in length equal to, or more than a width of the target.

7. A control method for a fluid discharging device, including a head having a predetermined number of nozzle arrays in which n (n is an integral number equal to, or more than 2) nozzles capable of discharging a predetermined fluid are arranged, the respective nozzle arrays formed to allow the fluid discharged from the kth (k=1, 2, . . . , n) nozzles belonging to the respective nozzle arrays to land on the same position on a target, a supply path that supplies the predetermined fluid to the respective nozzle arrays, a moving unit that relatively moves the head and the target, the method comprising controlling the moving unit to relatively move the head and the target and controlling the head in such a manner that, regarding all nozzles belonging to the predetermined number of nozzle arrays, the nozzles are divided into plural groups so that the nozzles belonging to at least two or more nozzle arrays to incorporate first to nth nozzles, the respective groups are switched to be set as a group for use with predetermined timing, and the nozzles belonging to the group for use are allowed to discharge the fluid to form dot rows on the target.

* * * * *